US009388012B2

(12) United States Patent
Suzuki et al.

(10) Patent No.: US 9,388,012 B2
(45) Date of Patent: Jul. 12, 2016

(54) SHEET STORING APPARATUS AND IMAGE FORMING APPARATUS EQUIPPED THEREWITH

(71) Applicant: CANON KABUSHIKI KAISHA, Tokyo (JP)

(72) Inventors: Yohei Suzuki, Mishima (JP); Masayoshi Fukatsu, Suntou-gun (JP); Hiroharu Tsuji, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/601,064

(22) Filed: Jan. 20, 2015

(65) Prior Publication Data

US 2015/0203319 A1 Jul. 23, 2015

(30) Foreign Application Priority Data

Jan. 21, 2014 (JP) ..... 2014-008931

(51) Int. Cl.
*B65H 31/24* (2006.01)
*B65H 31/30* (2006.01)
*B65H 31/02* (2006.01)

(52) U.S. Cl.
CPC ..... *B65H 31/24* (2013.01); *B65H 31/02* (2013.01); *B65H 31/3063* (2013.01); *B65H 31/3081* (2013.01); *B65H 2301/3121* (2013.01); *B65H 2301/4212* (2013.01); *B65H 2301/42266* (2013.01); *B65H 2403/21* (2013.01); *B65H 2403/41* (2013.01); *B65H 2405/115* (2013.01); *B65H 2405/332* (2013.01); *B65H 2408/111* (2013.01); *B65H 2408/1143* (2013.01); *B65H 2601/325* (2013.01); *B65H 2801/06* (2013.01)

(58) Field of Classification Search
CPC ..... B65H 31/24; B65H 31/3081; B65H 31/3063; B65H 2301/42266; B65H 2301/42268
See application file for complete search history.

(56) References Cited

U.S. PATENT DOCUMENTS 5,203,550 A * 4/1993 Kawano ..... B42C 1/125 270/58.14
5,673,906 A * 10/1997 Furuya ..... B42C 1/125 270/58.14
5,774,778 A * 6/1998 Adachi ..... G03G 15/6538 270/58.01
5,836,579 A * 11/1998 Hayashi ..... B42C 1/125 270/58.16
5,839,048 A * 11/1998 Kato ..... B42C 1/125 270/58.09
6,085,913 A * 7/2000 Aiko ..... B42C 1/125 209/540
6,361,042 B1 * 3/2002 Shimura ..... B65H 9/101 271/221
8,820,742 B2 * 9/2014 Koyanagi ..... B65H 31/24 271/224

(Continued)

FOREIGN PATENT DOCUMENTS

JP 2008-156089 A 7/2008

*Primary Examiner* — Patrick Cicchino
(74) *Attorney, Agent, or Firm* — Canon USA, Inc. IP Division

(57) ABSTRACT

A sheet storing apparatus includes a plurality of sheet storing units. Each of the sheet storing unit includes a fixed stacking portion configured to stack thereon a sheet conveyed by conveyance roller pairs, and a pushing unit configured to contact an edge of the sheet stacked on the stacking portion and to move the sheet in a direction substantially perpendicular to the sheet conveyance direction. A drive transmission unit for transmitting a driving force generated by a motor to drive the pushing unit is located upstream of the fixed stacking portion with respect to a direction in which the pushing unit moves the sheet. When the pushing unit is moving the sheet, a part of the drive transmission unit enters the inside of a sheet stacking range of the fixed stacking portion.

7 Claims, 12 Drawing Sheets

(56) References Cited

U.S. PATENT DOCUMENTS 8,955,836 B2 * 2/2015 Jones ..... B65H 31/3081
271/177

2014/0339765 A1 * 11/2014 Suzuki ..... B65H 31/24
271/303

* cited by examiner

SHEET STORING APPARATUS AND IMAGE FORMING APPARATUS EQUIPPED THEREWITH

BACKGROUND OF THE INVENTION

1. Field of the Invention

The present invention relates to a sheet storing apparatus that stores sheets and an image forming apparatus that is equipped with the sheet storing apparatus.

2. Description of the Related Art

Some conventional image forming apparatuses, such as copying machines, are equipped with a post-processing apparatus that temporarily stacks a plurality of sheets on a tray, staples the sheets, and discharges the stapled sheets (refer to FIG. 2 in Japanese Patent Application Laid-Open No. 2008-156089). Also, Japanese Patent Application Laid-Open No. 2008-156089 discusses a configuration in which, to move a plurality of sheets, a claw-shaped member capable of pushing out a plurality of sheets is driven by an endless belt mounted below a stacking portion.

SUMMARY OF THE INVENTION

According to an aspect of the present invention, a sheet storing apparatus includes a plurality of sheet stacking units that are lapped over one another in a sheet thickness direction, each of the plurality of sheet stacking units including a stacking portion configured to stack thereon a sheet conveyed by a conveyance unit configured to convey the sheet, and a contact member including a contact portion configured to contact an edge of the sheet stacked on the stacking portion, the contact member being configured to move the sheet in a direction perpendicular to a direction in which the conveyance unit conveys the sheet, the contact member being movable between a standby position and a moved position and being moved from the standby position to the moved position to move the sheet stacked on the stacking portion, wherein, in a state in which the contact member is located in the standby position, the contact portion of the contact member is located upstream of the edge of the sheet conveyed by the conveyance unit with respect to a direction in which the contact member is moved from the standby position to the moved position.

Further features of the present invention will become apparent from the following description of exemplary embodiments with reference to the attached drawings.

DESCRIPTION OF THE EMBODIMENTS

Figure 3:
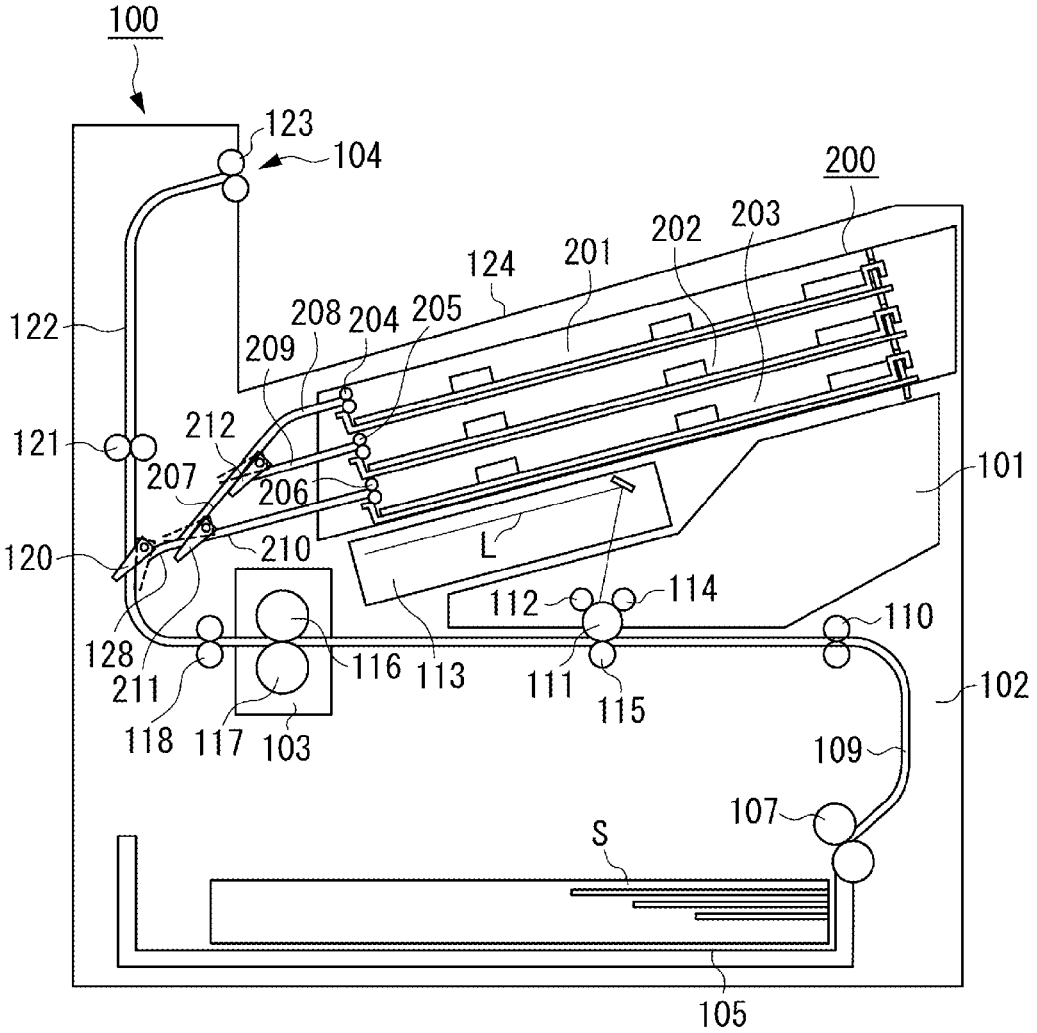
FIG. 3 is a sectional view illustrating an overall configuration of an image forming apparatus according to the first exemplary embodiment.

Various exemplary embodiments, features, and aspects of the invention will be described in detail below with reference to the drawings. FIG. 3 is a sectional view illustrating a configuration of an image forming apparatus 100 equipped with a sheet storing apparatus 200 according to a first exemplary embodiment. As illustrated in FIG. 3, a main body of the image forming apparatus 100 (hereinafter referred to as an apparatus body 100) includes an image forming unit 101, a feeding unit 102, which feeds a sheet S to the image forming unit 101, a fixing unit 103, and a sheet discharging unit 104. The sheet storing apparatus 200, which temporarily stores a sheet S having an image formed thereon, is attached to the apparatus body 100.

The image forming unit 101 includes a photosensitive drum 111, which rotates clockwise as viewed in FIG. 3, an exposure device 113, and a charging roller 112, a developing device 114, and a transfer roller 115, which are arranged almost in turn along the rotational direction of the photosensitive drum 111. The image forming unit 101 uses such process units to form a toner image on the sheet S with an electrophotographic image forming process.

The feeding unit 102, which feeds a sheet S, includes a feeding cassette 105, in which sheets S to be image-formed are stored, a feeding roller 107, a conveyance guide 109, and a registration roller 110.

The fixing unit 103 includes a fixing roller 116, a pressure roller 117, which is caused to contact the fixing roller 116 from below, and a fixing discharging roller pair 118, and is configured to fix a toner image formed on the sheet S by the image forming unit 101.

The sheet discharging unit 104 includes a first switching member 120, a conveyance roller 121, a discharging guide 122, a discharging roller 123, and a discharging stacking portion 124, which is formed on the top surface of the apparatus body 100.

The first switching member 120 can be switched by a central processing unit (CPU) 50 (illustrated in FIG. 11) between a position indicated with the solid line in FIG. 3 to direct the image-formed sheet S toward the sheet storing apparatus 200 and a discharging position indicated with the broken line to discharge the image-formed sheet S to the discharging stacking portion 124.

Figure 11:
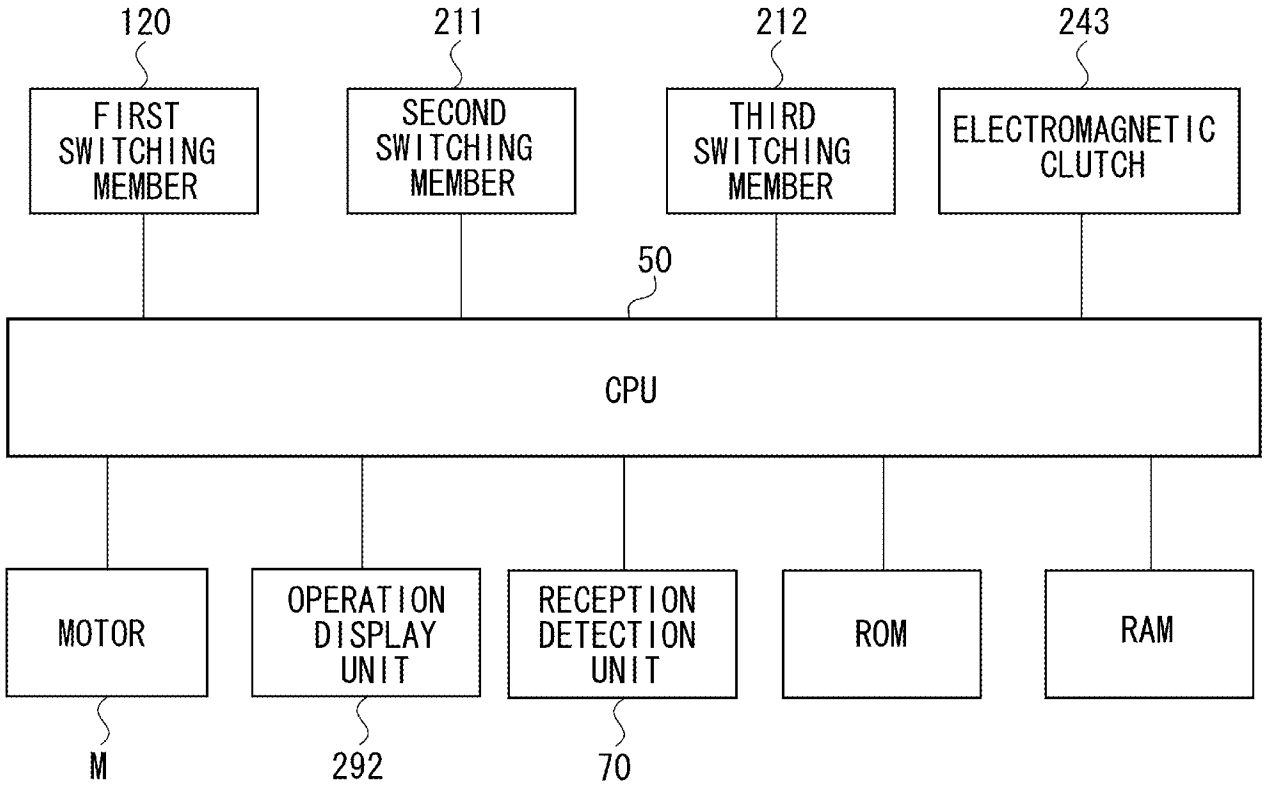
FIG. 11 is a block diagram according to the first exemplary embodiment.

FIG. 11 is a block diagram according to the first exemplary embodiment. As illustrated in FIG. 11, the CPU 50 is connected to a read-only memory (ROM) and a random access memory (RAM). The CPU 50 uses the RAM as a work memory to execute a program stored in the ROM.

Next, an image forming operation of the apparatus body 100 is described. When the apparatus body 100 receives image information from an external apparatus, such as a personal computer (PC), or a network, such as a local area network (LAN), the exposure device 113 emits laser light L based on the image information. The laser light L exposes the surface of the photosensitive drum 111, which is uniformly charged at a predetermined polarity and potential by the charging roller 112.

This removes electric charge from the exposed portion of the surface of the photosensitive drum 111, so that an electrostatic latent image is formed on the surface of the photosensitive drum 111. Then, toner is attached to the photosensitive drum 111 by the developing device 114 to make the electrostatic latent image visible as a toner image. The toner image on the photosensitive drum 111 is transferred onto the sheet S at a transfer nip portion formed between the photosensitive drum 111, which is rotating clockwise, and the transfer roller 115.

On the other hand, the sheet S to be supplied to the image forming unit 101 is separated and fed on a sheet-by-sheet basis from the feeding cassette 105 by the feeding roller 107, and is then conveyed to the registration roller 110 along the conveyance guide 109. At this time, since the registration roller 110 is in a stopped state, the sheet S is temporarily stopped by the registration roller 110. Then, the sheet S, which has been temporarily stopped, is conveyed to the transfer nip portion by the registration roller 110, which starts to rotate with timing synchronized with a toner image formed by the image forming unit 101.

The toner image formed on the photosensitive drum 111 is transferred onto the sheet S by the transfer roller 115. Then, the sheet S having the toner image transferred thereon is conveyed to the fixing unit 103, and is nipped and conveyed by the fixing nip portion formed between the fixing roller 116 and the pressure roller 117. At the fixing nip portion, the sheet S is heated and pressed, so that the toner image is fixed onto the surface of the sheet S.

In a case where the sheet S is to be discharged and stacked onto the discharging stacking portion 124, the CPU 50 sets the first switching member 120 to a position (position indicated with the broken line) to convey the sheet S toward the discharging roller 123. Accordingly, the sheet S having an image formed thereon is conveyed along the discharging guide 122 by the conveyance roller 121 and is then discharged onto the discharging stacking portion 124 by the discharging roller 123.

On the other hand, in a case where the sheet S is to be conveyed to the sheet storing apparatus 200, the CPU 50 previously sets the first switching member 120 to a position indicated with the solid line in FIG. 3. Accordingly, the sheet S is conveyed toward the sheet storing apparatus 200 from the apparatus body 100 through a conveyance path 128.

The sheet storing apparatus 200 includes a plurality of sheet storing units 201 to 203 that are lapped over one another. Conveyance roller pairs (conveyance members) 204 to 206 respectively convey sheets S to the sheet storing units 201 to 203.

Figure 4:
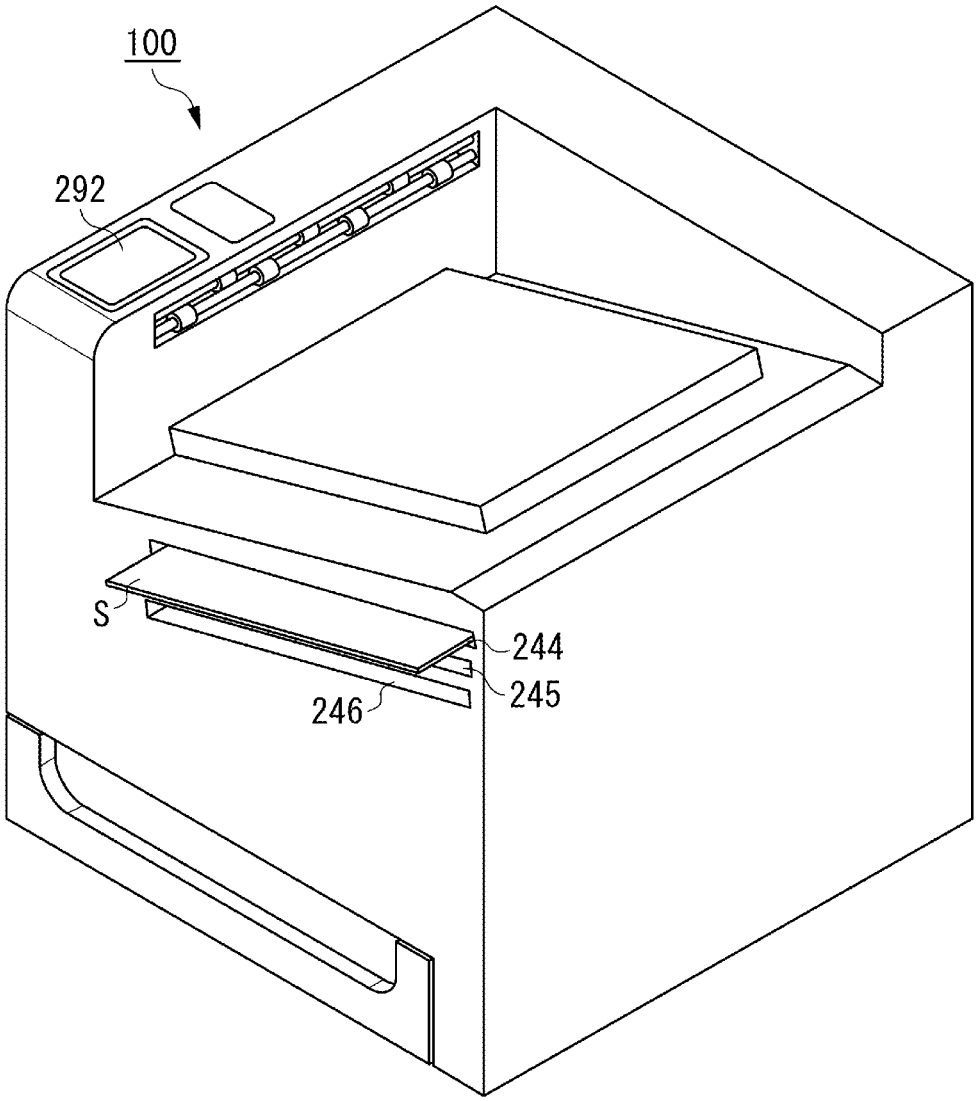
FIG. 4 is a perspective view illustrating an external appearance of the image forming apparatus according to the first exemplary embodiment.

As illustrated in FIG. 4, the sheet storing units 201 to 203 respectively include discharge ports 244 to 246, via which the sheets S stored in the sheet storing units 201 to 203 are respectively discharged to the outside.

The conveyance destination of the sheet S is switched by a second switching member 211 and a third switching member 212. Thus, the sheet S is guided by the conveyance guides 207 to 210 and is then conveyed to any one of the sheet storing units 201 to 203.

The second switching member 211 and the third switching member 212 are switched between a position indicated with the solid line and a position indicated with the broken line in FIG. 3 by an actuator (not illustrated) controlled by the CPU 50. For example, in a case where the sheet S is to be conveyed to the sheet storing unit 201, the CPU 50 respectively switches the first to third switching members 120, 211, and 212 to the positions indicated with the solid line in FIG. 3. Accordingly, the sheet S passes through the conveyance guides 207 and 208 in this order from the conveyance guide 128, and is then conveyed to the sheet storing unit 201.

Also, in a case where the sheet S is to be conveyed to the sheet storing unit 202, the CPU 50 switches and holds only the third switching member 212 to the position indicated with the broken line. Accordingly, the sheet S passes through the conveyance guides 128, 207, and 209 in this order, and is then conveyed to the sheet storing unit 202.

Next, the more details of the configuration of the sheet storing apparatus 200 are described. In the present exemplary embodiment, since the sheet storing units 202 and 203 have the same configuration as that of the sheet storing unit 201, only the sheet storing unit 201 is described, and the other sheet storing units 202 and 203 are omitted from description.

Figure 2A:
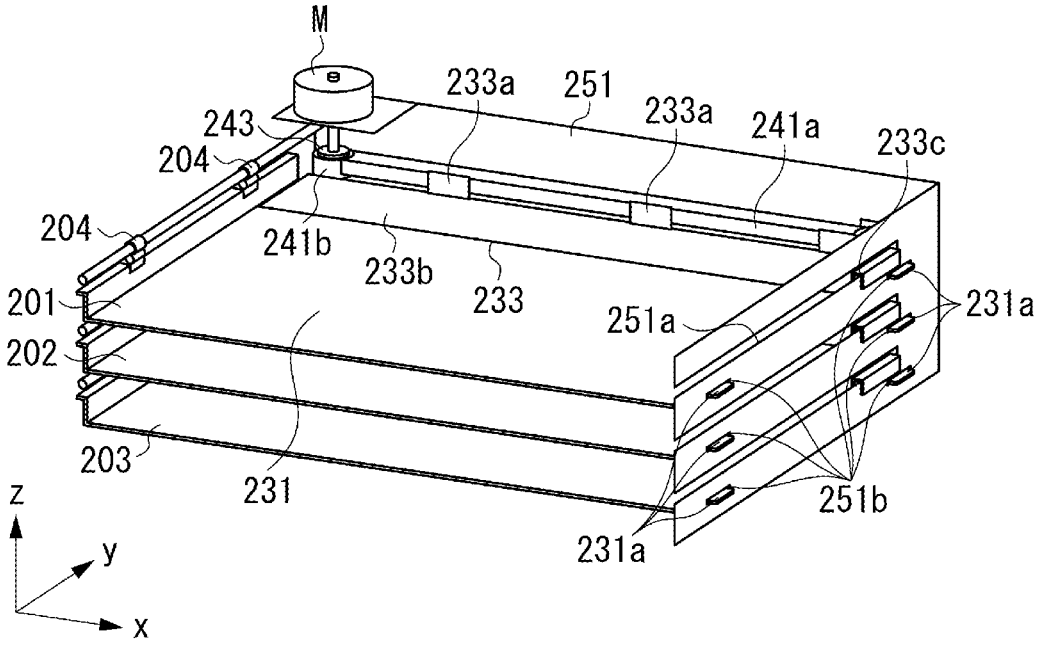
FIGS. 2A and 2B are perspective views illustrating a configuration of a sheet storing apparatus according to the first exemplary embodiment.
Figure 2B:
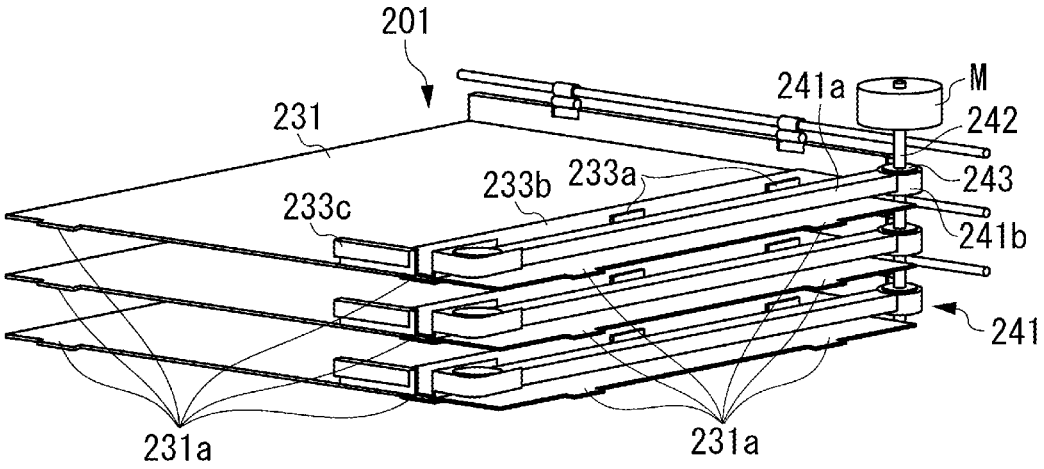

First, the whole picture of the sheet storing apparatus 200 is described. FIGS. 2A and 2B are perspective views illustrating a configuration of the sheet storing apparatus 200. FIG. 2A is a perspective view of the sheet storing apparatus 200 as viewed from the side of the sheet storing units 201 to 203. FIG. 2B is a perspective view of the sheet storing apparatus 200 with a frame 251 removed as viewed from the side of drive transmission units, which are described below. As illustrated in FIGS. 2A and 2B, the sheet storing unit 201 includes conveyance roller pairs 204, which are configured to convey the sheet S to the sheet storing string unit 201, and a fixed stacking portion 231, which is configured to stack thereon the sheet S conveyed by the conveyance roller pairs 204. The fixed stacking portion 231 is fixed to the frame 251 with protruding portions 231*a* of the fixed stacking portion 231 inserted into rectangle holes 251*b* (partially not illustrated on the back side in FIG. 2A) formed on the frame 251.

The sheet storing unit 201 further includes a pushing unit 233 configured to push an edge of the sheet S in a direction perpendicular to the conveyance direction of the sheet S stacked on the fixed stacking portion 231 to move a part of the sheet S up to a position where the sheet S is receivable by the user. The pushing unit 233 includes protrusion-shaped contact portions 233*a*, which are configured to contact the edge of the sheet S in the direction perpendicular to the conveyance direction of the sheet S. The contact portions 233*a* each extend in the sheet thickness direction so as to be able to push a plurality of sheets S at a time. In the first exemplary embodiment, the height of each of the contact portions 233*a* is set to 5 mm so as to be able to push about 20 sheets S at a time. The pushing unit 233 further includes a moving stacking portion 233*b*, which is formed to be movable integrally with the contact portions 233*a* and configured to stack thereon a portion of the sheet S. The moving stacking portion 233*b* is in the shape of a surface folded at the contact portions 233*a*.

Furthermore, the moving stacking portion 233*b* extends by a length equal to or greater than the length of the sheet S in the x direction in FIG. 2A. A moving guide 233*c* is formed at the extended end portion of the moving stacking portion 233*b*. The moving guide 233*c* engages with a rail 251*a* of the frame 251 to restrict the positions of the moving stacking portion 233*b* in the x direction and the plus z direction in FIG. 2A. The moving stacking portion 233*b* is arranged on the upper surface of the fixed stacking portion 231 in a contact state and is thus restricted from moving in the minus z direction in FIG. 2A. Therefore, the pushing unit 233 is movable only in the y direction in FIG. 2A.

Figure 1A:
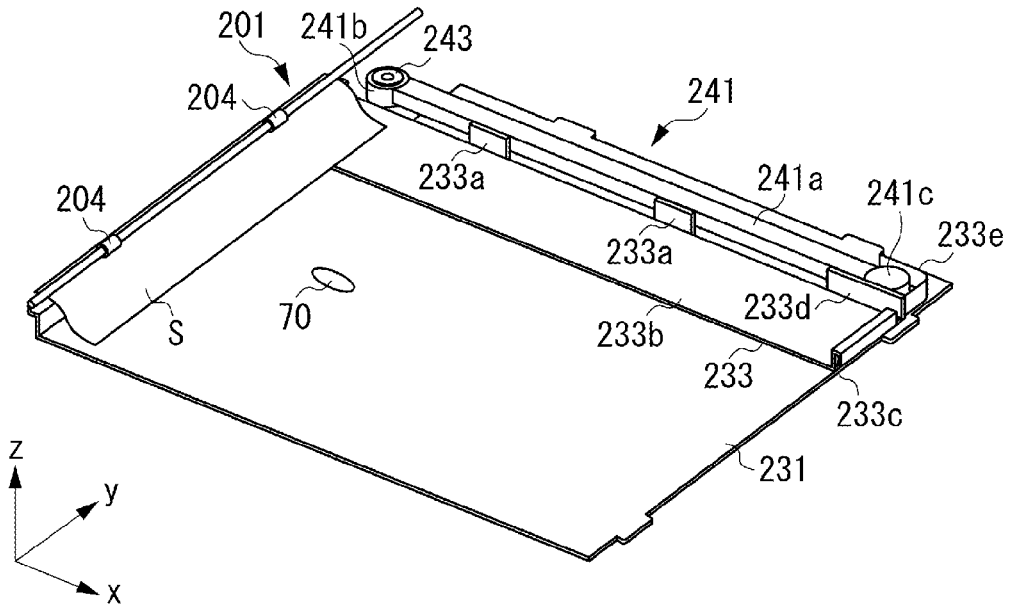
FIGS. 1A and 1B are perspective views illustrating a configuration of a sheet storing unit according to a first exemplary embodiment.
Figure 1B:
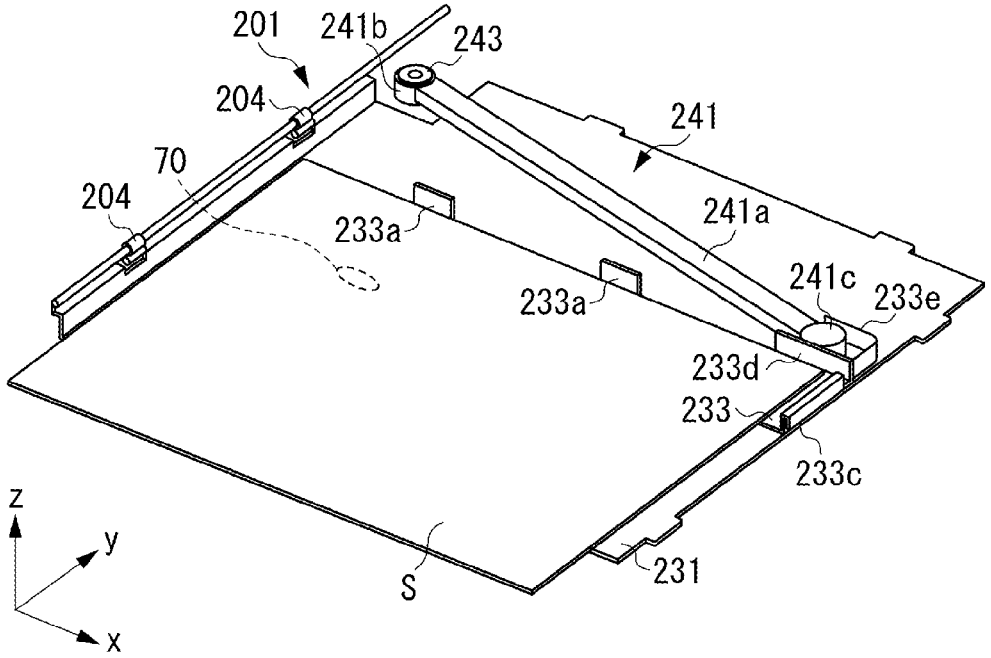

Next, the configuration of a drive transmission unit (an engaging portion) 241 is described. As illustrated in FIGS. 2A and 2B, the drive transmission unit 241 is arranged on the upstream side in the direction in which the pushing unit 233 of the sheet storing unit 201 moves (in the y direction in FIG. 2A). The drive transmission unit 241 includes a lever 241*a*, a lever rotation supporting portion 241*b*, and a lever contact portion 241*c* (FIGS. 1A and 1B).

An electromagnetic clutch 243 is formed on the lever rotation supporting portion 241*b*. The electromagnetic clutch 243 is connected to a motor M via a lever drive shaft 242 and is configured to transmit a driving force of the motor M to the lever rotation supporting portion 241*b* depending on the turning on and off of the electromagnetic clutch 243. As the motor M rotates in the normal direction and reverse direction, the lever 241*a* swigs (moves) around the lever rotation supporting portion 241*b*. In other words, the motor M and the electromagnetic clutch 243 function as a first movement unit that moves the lever 241*a* to move the contact portions 233*a* together with a first movement contact portion 233*d* and a second movement contact portion 233*e* (FIGS. 1A and 1B).

Next, a sequence of operations performed until the sheet S is discharged is described with reference to FIGS. 1A and 1B. FIGS. 1A and 1B are perspective views of the sheet storing unit 201. In the state illustrated in FIG. 1A, the contact portions 233*a* and the moving stacking portion 233*b* are in the standby position. The contact portions 233*a* when located in the standby position do not disturb the conveyance and stacking of the sheet S onto the fixed stacking portion 231 of the sheet storing unit 201 via the conveyance roller pairs 204. In other words, the standby position of the contact portions 233*a* is arranged upstream of the edge of the sheet S conveyed by the conveyance roller pairs 204 with respect to the direction in which the contact portions 233*a* move. In the state illustrated in FIG. 1B, the contact portions 233*a* and the moving stacking portion 233*b* are in the discharging position.

When the sheet S is to be stored in the sheet storing unit 201, the sheet S is conveyed to the sheet storing unit 201 via the conveyance roller pairs 204. At this time, the pushing unit 233 is in the standby position so as not to disturb the conveyance of the sheet S via the conveyance roller pairs 204.

When the user issues a discharging instruction via an operation display unit 292 (FIG. 4) mounted on the apparatus body 100, the CPU 50 starts a discharging operation for the sheet S via the pushing unit 233.

When performing the discharging operation, the CPU 50 first turns on the electromagnetic clutch 243, and then rotates the motor M in the normal direction to swings the lever 241*a*. When the lever 241*a* is swung, the lever contact portion 241*c* formed on the tip of the lever 241*a* contacts (engages with) the first movement contact portion (a first engaged portion) 233*d*. Then, the lever contact portion 241*c* moves the pushing unit 233 from the standby position to the discharging position to move the sheet S. At this time, since the lower surface of the fixed stacking portion 231 serves as a ceiling plane of the sheet storing unit 202, a sheet S can be conveyed to the sheet storing unit 202 even when the sheet S stacked in the sheet storing unit 201 is being discharged.

When the sheet S has been moved to the position illustrated in FIG. 1B, a part of the sheet S is exposed from a discharge port 244 as illustrated in FIG. 4, so that the sheet S becomes receivable by the user. When a reception detection unit 70 (FIG. 11), which is a reflection-type sensor, detects that the user has received the sheet S discharged from the discharge port 244, the CPU returns the pushing unit 233 from the discharging position to the standby position. To return the pushing unit 233 to the standby position, the CPU 50 rotates the motor M in the reverse direction to swing the lever 241*a* in the direction opposite to the direction in which the lever 241*a* swings to discharge the sheet S. At this time, the lever contact portion 241*c* contacts (engages with) the second movement contact portion (a second engaged portion) 233*e* formed on the pushing unit 233 to move the pushing unit 233. This enables the sheet storing unit 201 to receive a next sheet.

Furthermore, the sheet storing units 202 and 203 also have a configuration similar to that of the sheet storing unit 201. Thus, the CPU 50 can energize only the electromagnetic clutch 243 of any one of the sheet storing units 201 to 203 to selectively transmit a driving force to the lever 241*a*. Then, the CPU 50 can swing the lever 241*a* of the selected sheet storing unit to move the pushing unit 233, thus discharging the sheet S.

As described above, in the first exemplary embodiment, the drive transmission unit 241, which transmits a drive force for discharging a sheet stored in the sheet storing unit 201, is located upstream of the moving stacking portion 233*b* in the sheet discharging direction with respect to the sheet width direction (the y direction in FIG. 2A).

Accordingly, the thickness required for the sheet storing unit 201 can be constituted only by a space for disposing the conveyance roller pairs 204, the thicknesses of the fixed stacking portion 231 and the moving stacking portion 233*b*, and a space for stacking sheets.

According to the first exemplary embodiment, the sheet storing apparatus 200 can be downsized in the height direction. In particular, even when the sheet storing apparatus 200 is equipped with a plurality of sheet storing units that are lapped over one another, the height thereof can be minimized.

Furthermore, according to the first exemplary embodiment, even when a sheet S is being discharged from a sheet storing unit, another sheet S can be conveyed to another sheet storing unit.

Next, a second exemplary embodiment is described. In the second exemplary embodiment, the description of configurations and operations similar to those of the first exemplary embodiment is not repeated as appropriate. The second exemplary embodiment differs from the first exemplary embodiment in the configuration of a drive transmission unit.

Figure 5A:
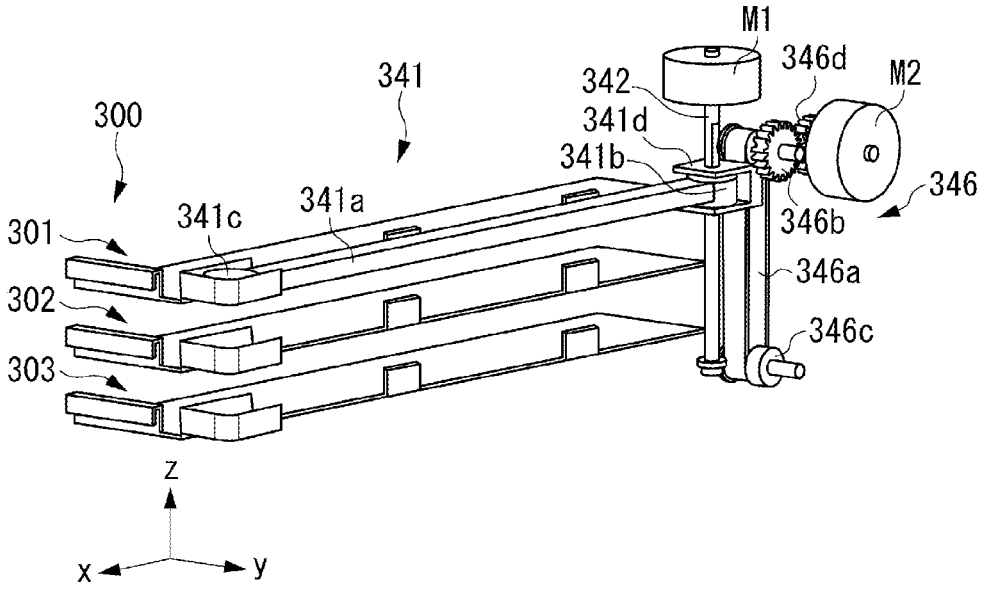
FIGS. 5A and 5B are perspective views illustrating a configuration of a sheet storing unit according to a second exemplary embodiment.
Figure 5B:
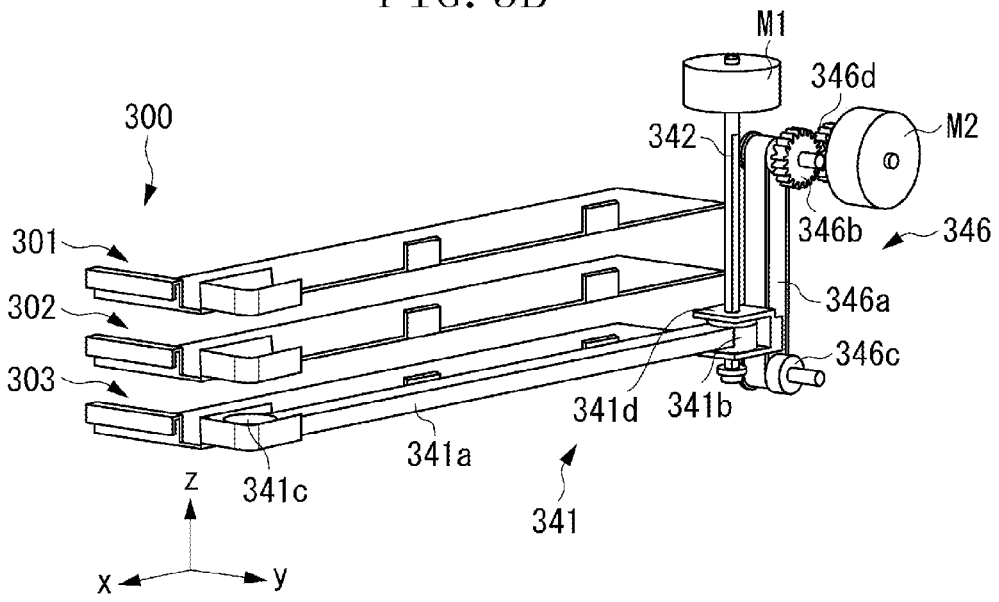

First, a configuration of the second exemplary embodiment is described with reference to FIGS. 5A and 5B. FIGS. 5A and 5B are perspective views illustrating a part of a sheet storing apparatus 300 and a main portion of a drive transmission unit 341 according to the second exemplary embodiment. As illustrated in FIGS. 5A and 5B, in the second exemplary embodiment, the drive transmission unit (an engaging portion) 341 for discharging sheets from three sheet storing units 301, 302, and 303 has a configuration including a single lever. The drive transmission unit 341 includes a lever 341*a*, a lever rotation supporting portion 341*b*, a lever contact portion 341*c*, and a lever holding portion 341*d*. The lever rotation supporting portion 341*b* has a D-cut shape in section so as to be movable in the z direction (FIGS. 5A and 5B) integrally with a lever drive shaft 342 and to be rotatable integrally with the lever drive shaft 342. Therefore, the lever rotation supporting portion 341*b* is able to transmit a driving force from a Motor M1 to the lever 341*a*.

Furthermore, a lifting and lowering unit (a second movement unit) 346 includes a lifting and lowering belt 346*a*, a lifting and lowering pulley gear 346*b*, a lifting and lowering pulley 346*c*, a lifting and lowering pinion 346*d*, and a motor M2. The lever holding portion 341*d* engages with the lifting and lowering belt 346*a* and is configured to move integrally with the lifting and lowering belt 346*a*. The lifting and lowering pulley gear 346*b* meshes with the lifting and lowering pinion 346*d*, which is arranged integrally with the shaft of the motor M2, and transmits a driving force from the motor M2 to the lifting and lowering belt 346*a*. The CPU 50 can rotate the motor M2 in the normal and reverse directions to lift and lower the drive transmission unit 341 in the thickness direction of the sheet S (in the z direction in FIGS. 5A and 5B). In other words, the CPU 50 can control the lifting and lowering unit 346 to lift and lower the drive transmission unit 341 to the position corresponding to the first movement contact portion 233*d* and the second movement contact portion 233*e* of any one of a plurality of sheet storing units.

Figure 12:
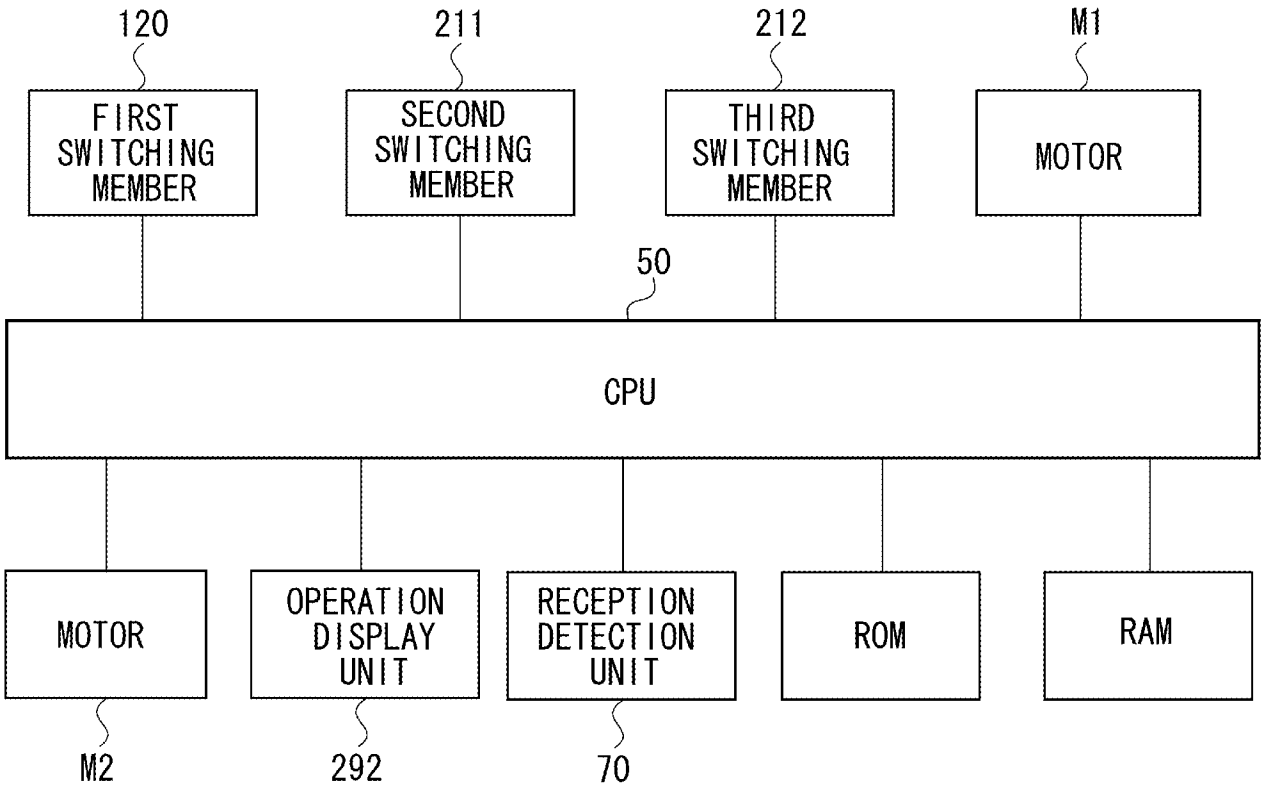
FIG. 12 is a block diagram according to the second exemplary embodiment.

Next, a sequence of operations for discharging the sheet S stored in a sheet storing unit is described. The CPU 50 (FIG. 12) can discharge the sheets S stacked on three sheet storing units 301 to 303 at an instructed time based on an instruction from the user. Furthermore, the CPU 50 can optionally select any one of the sheet storing units 301 to 303 and discharge the sheet S from the selected sheet storing unit.

To discharge the sheets S stored in the sheet storing units 301 to 303, the CPU 50 controls the lifting and lowering unit 346 via the motor M2 to lift or lower the drive transmission unit 341 to the position corresponding to one of the sheet storing units 301 to 303 in which the sheet S to be discharged is stored. Next, the CPU 50 controls the drive transmission unit 341 via the motor M1 to swing the lever 341*a*, thus moving the pushing unit 233 in the sheet discharging direction. With the pushing unit 233 moved, the contact portions 233*a* push out the sheet S to discharge the sheet S. When the reception detection unit 70 (FIG. 12) detects that the user has received the sheet S discharged from the discharge port 244, the CPU 50 returns the pushing unit 233 from the discharging position to the standby position.

The second exemplary embodiment provides a configuration having a single lever 341*a* in addition to the advantageous effect obtained in the first exemplary embodiment. Accordingly, even in a case where, for example, three or more sheet storing units are lapped over one another, there is no need to add a lever and an electromagnetic clutch to every sheet storing unit. Therefore, the second exemplary embodiment facilitates the realization of multi-stage sheet storing units.

Modification Examples

The above first and second exemplary embodiments have been described with a configuration in which three sheet storing units are lapped over one another. However, the present invention is not limited to such a configuration. The present invention can also apply to a configuration in which, for example, two sheet storing units or four or more sheet storing units are lapped over one another.

Furthermore, the above first exemplary embodiment has been described with a configuration in which a single motor M is used as a drive source for the drive transmission unit 241. However, the present invention is not limited to such a configuration. The present invention can also apply to a configuration in which, for example, motors are arranged for the respective sheet storing units.

Moreover, the above first and second exemplary embodiments have been described with a configuration in which the fixed stacking portion 231 is a planar member. However, the present invention is not limited to such a configuration. The present invention can also apply to a configuration in which, for example, the fixed stacking portion 231 is a linear member or a belt-like member.

Additionally, in the above-described second exemplary embodiment, the position of the drive transmission unit 341 in the z direction in FIG. 2A is controlled only by the action of the motor M2. However, this is not restrictive. For example, a detection sensor for detecting the position of the lifting and lowering unit 346 may be provided to detect the position of the drive transmission unit 341 in the z direction. Moreover, the lifting and lowering unit 346 may be composed of a rack and pinion mechanism instead of a belt.

Furthermore, in the above-described first and second exemplary embodiments, the position of the lever 241*a* or 341*a* in the swinging direction is controlled only by the motor M or M1. However, this is not restrictive. For example, the position of the lever in the swinging direction may be detected by a sensor or the like to improve positional accuracy.

Furthermore, in the above-described second exemplary embodiment, a single lever 341*a* is included in the drive transmission unit 341. However, this is not restrictive. For example, a plurality of levers may be included in the drive transmission unit 341.

Furthermore, the above first and second exemplary embodiments have been described with a configuration in which the sheet storing apparatus 200 is mounted inside the image forming apparatus 100. However, the present invention is not limited to such a configuration. The present invention can also apply to a configuration in which, for example, a sheet storing apparatus is mounted outside an image forming apparatus.

In addition, the above first and second exemplary embodiments have been described with a configuration in which the pushing unit is restricted by the rail provided in the frame. However, the present invention is not limited to such a configuration. The present invention can also apply to a configuration in which, for example, a rail member is provided separately from the frame or the pushing unit is guided by a groove provided in the fixed stacking portion.

Furthermore, the above first and second exemplary embodiments have been described with a configuration having a moving stacking portion. However, the present invention is not limited to such a configuration. The present invention can also apply to a configuration in which, for example, the moving stacking portion is omitted and a protruding portion that protrudes from the lower part of the contact portion is inserted into a groove formed in the fixed stacking portion.

Furthermore, the above first and second exemplary embodiments have been described with a configuration in which the lower surface of the stacking portion serves a ceiling plane of the lower sheet storing unit. However, the present invention is not limited to such a configuration. The present invention can also apply to a configuration in which, for example, a separate guide member or the like, which is arranged on the lower surface of the stacking portion, is used as a ceiling plane or a sheet conveyance guide.

Moreover, the above first and second exemplary embodiments have been described with a configuration in which the pushing unit is composed of integrally formed components. However, the present invention is not limited to such a configuration. The present invention can also apply to a configuration in which, for example, individual components are coupled to constitute the pushing unit.

Figure 6:
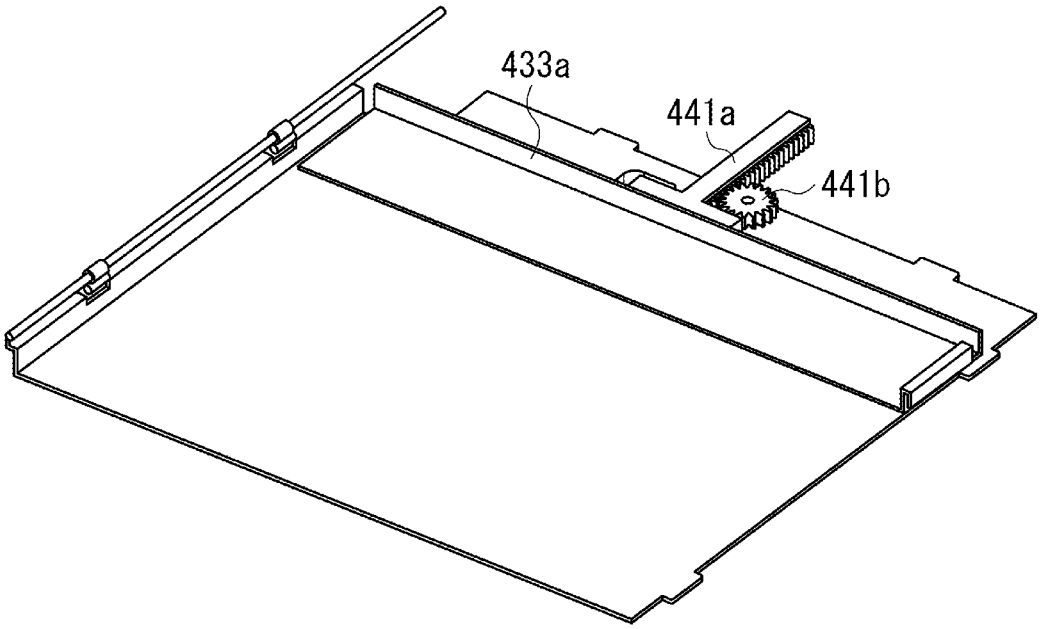
FIG. 6 illustrates a configuration of a sheet storing unit according to a modification example.

Additionally, the above first and second exemplary embodiments have been described with a configuration in which the drive transmission unit 241 or 341 is in the shape of a lever. However, the present invention is not limited to such a configuration. The present invention can also apply to a configuration in which, for example, as illustrated in FIG. 6, a combination of a rod 441*a*, on which a rack is integrally formed, and a pinion 441*b*, which rotates with a driving force transmitted from the motor, moves a contact portion 433*a*.

Figure 7:
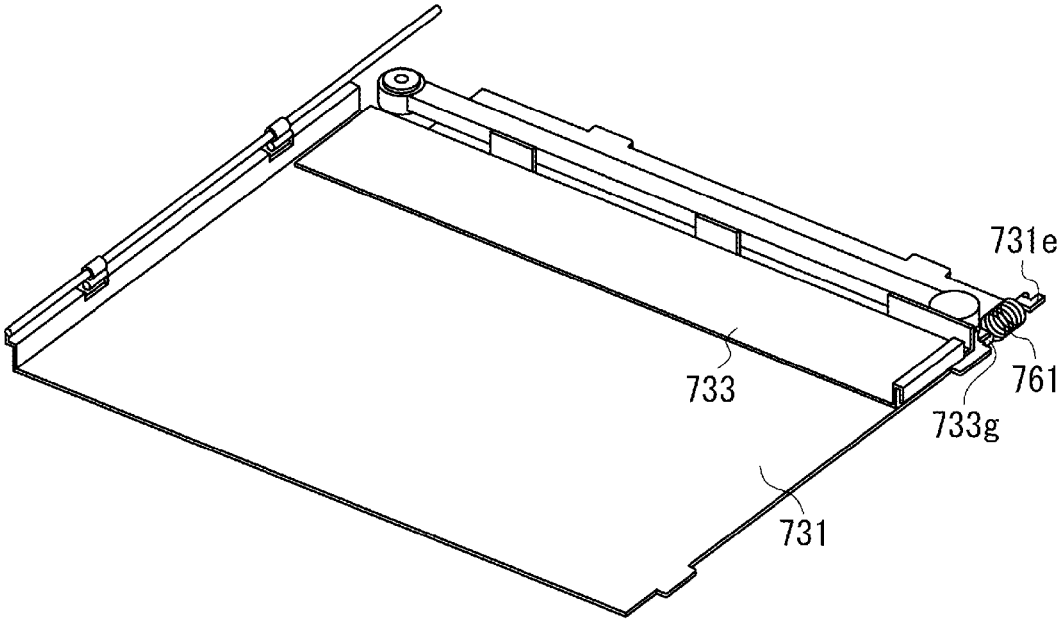
FIG. 7 illustrates a configuration of a sheet storing unit according to another modification example.

Furthermore, the above first and second exemplary embodiments have been described with a configuration in which, to return the pushing unit 233 to the standby position, the lever 241*a* is caused to contact the second movement contact portion 233*e* formed on the pushing unit 233. However, the present invention is not limited to such a configuration. The present invention can also apply to a configuration in which, for example, as illustrated in FIG. 7, spring hook portions 731*e* and 733*g* are respectively formed on a fixed stacking portion 731 and a pushing unit 733, and a return spring 761 is mounted between the spring hook portions 731*e* and 733*g*. This configuration enables the pushing unit 733 to be returned to the standby position due to the urging force of the return spring 761.

Figure 8:
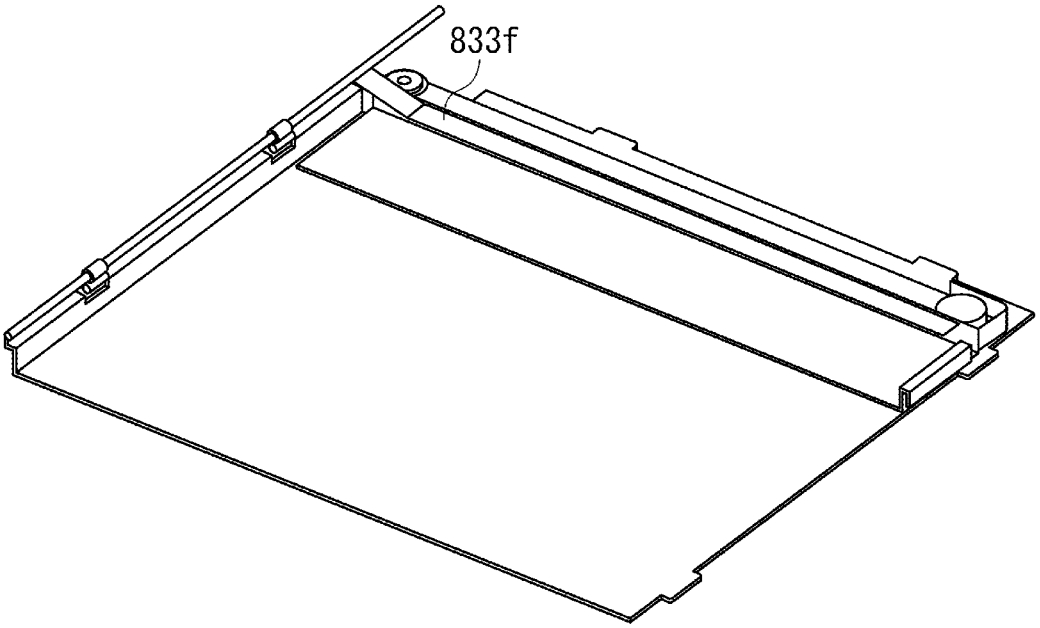
FIG. 8 illustrates a configuration of a sheet storing unit according to yet another modification example.

Additionally, in the above-described first and second exemplary embodiments, two separate contact portions 233*a* are arranged. However, this is not restrictive. For example, as illustrated in FIG. 6, the contact portion 433*a* may be formed wide enough to contact the entire longitudinal side of a sheet. Furthermore, as illustrated in FIG. 8, a contact upper surface portion 833*f* may be formed. In this case, a side portion of the contact upper surface portion 833*f* closer to the conveyance roller pairs 204 is preferably formed to be close to the vicinity of a roller nip so as to allow the sheet S to be surely conveyed. With this configuration, when the sheet S is moved by the pushing unit, the sheet S can be moved with not only the sheet edge but also the upper surface side in the sheet thickness direction pushed. Therefore, even if the edge portion is deformed, for example, curled, the sheet S can be surely moved.

Figure 9:
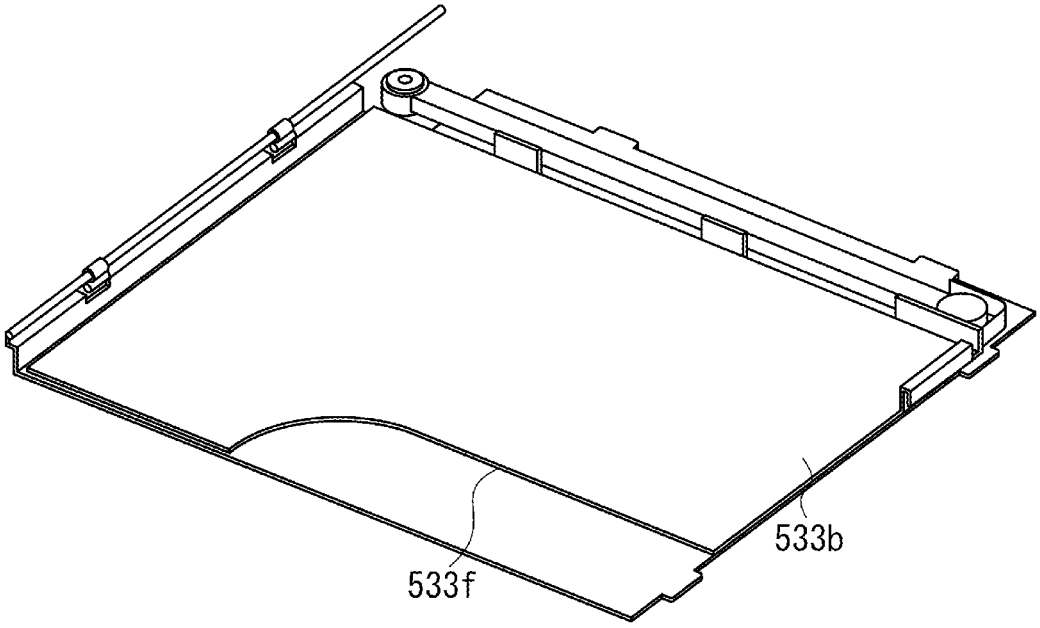
FIG. 9 illustrates a configuration of a sheet storing unit according to yet another modification example.

In addition, the above first and second exemplary embodiments have been described with a configuration in which a trailing-edge portion of the sheet S in the moving direction is stacked on the moving stacking portion 233*b*. However, the present invention is not limited to such a configuration. The present invention can also apply to a configuration in which, for example, as illustrated in FIG. 9, the whole surface of the sheet S is stacked on a moving stacking portion 533*b*. In this case, a cutout 533*f* or the like may be formed on the downstream side of the moving stacking portion 533*b* so that the user can easily receive the sheet S. With this configuration, a sliding friction between the sheet S and the fixed stacking portion 231, which would occur when the sheet S is discharged from the sheet storing unit, does not occur. Therefore, it is possible to prevent the occurrence of friction noise or the damage of the sheet S.

Figure 10:
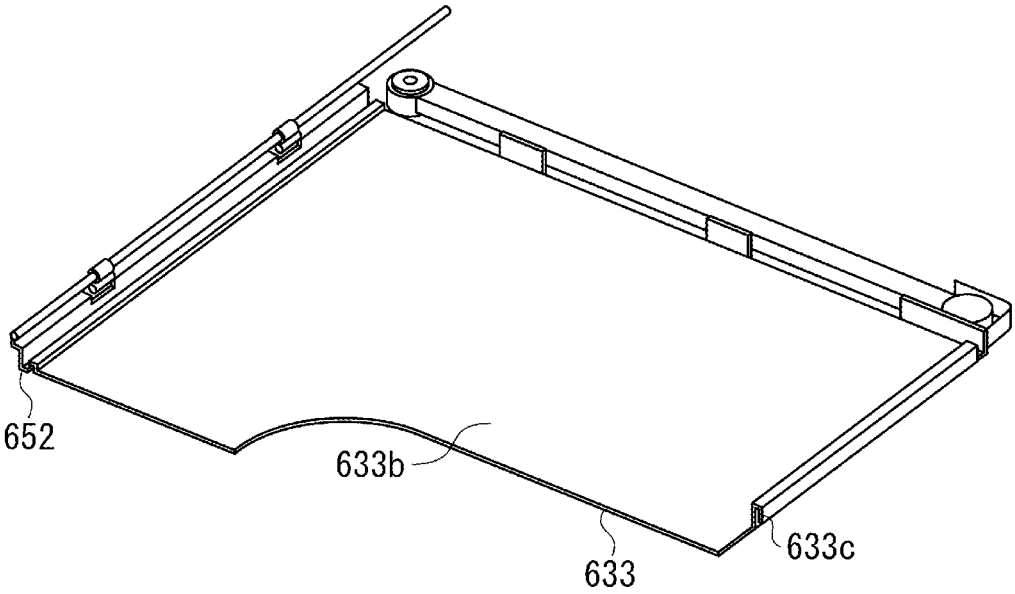
FIG. 10 illustrates a configuration of a sheet storing unit according to yet another modification example.

Furthermore, the above first and second exemplary embodiments have been described with a configuration in which the moving stacking portion 233*b* is arranged on the fixed stacking portion 231. However, the present invention is not limited to such a configuration. The present invention can also apply to a configuration in which, for example, as illustrated in FIG. 10, the fixed stacking portion 231 is omitted, the whole or partial surface of the sheet S is supported from below by a moving stacking portion 633*b*, and the position of a pushing unit 633 in the sheet moving direction is restricted by a guide rail 652 on the conveyance roller pair side and a rail 251*a* of the frame 251. With this configuration, the thickness of the sheet storing unit can be reduced as much as the thickness of the fixed storing portion. Therefore, it is possible to further reduce the height of the image storing apparatus than in the first exemplary embodiment.

Additionally, in the above-described first and second exemplary embodiments, the sheet storing apparatus 200 or 300 is mounted aslant for the purpose of downsizing. However, this is not restrictive. For example, with importance attached to the ease of the user receiving the sheet S, the sheet storing apparatus may be mounted horizontally to allow the sheet S to be discharged horizontally.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-008931 filed Jan. 21, 2014, which is hereby incorporated by reference herein in its entirety.

What is claimed is:

1. A sheet storing apparatus comprising:

a plurality of sheet stacking units that are lapped over one another in a sheet thickness direction, wherein each of the plurality of sheet stacking units includes:

a stacking portion on which a sheet conveyed by a conveyance unit is stacked, and a contact member including a contact portion configured to contact an edge of the sheet stacked on the stacking portion and an engaged portion that is movable integrally with the contact portion, wherein the contact member is configured to move the sheet stacked on the stacking portion in a direction perpendicular to a direction in which the conveyance unit conveys the sheet and discharges the sheet through a discharge port to outside of the sheet storing apparatus, and wherein the contact member is moved from a standby position to a moved position to discharge the sheet, wherein, in a state where the contact member is located in the standby position, the contact portion of the contact member is located upstream of the edge of the sheet conveyed by the conveyance unit in a direction in which the contact member is moved from the standby position to the moved position;

wherein the sheet storing apparatus further comprises:

a plurality of engaging portions, wherein the number of the plurality of engaging portions corresponds to the number of the plurality of engaged portions included in the plurality of the sheet stacking units; and a moving unit configured to engage any one of the plurality of engaging portions with the corresponding engaged portion to move the corresponding contact portion, wherein the moving unit includes a drive source configured to generate a driving force, wherein each of the plurality of engaging portions is movable by the driving force generated by the drive source, and wherein the moving unit further includes an electromagnetic clutch configured to transmit the driving force generated by the drive source to any one of the plurality of engaging portions.

2. A sheet storing apparatus comprising:

a plurality of sheet stacking units that are lapped over one another in a sheet thickness direction, wherein each of the plurality of sheet stacking units includes:

a stacking portion on which a sheet conveyed by a conveyance unit is stacked, and a contact member including a contact portion configured to contact an edge of the sheet stacked on the stacking portion and an engaged portion that is movable integrally with the contact portion, wherein the contact member is configured to move the sheet stacked on the stacking portion in a direction perpendicular to a direction in which the conveyance unit conveys the sheet and discharges the sheet through a discharge port to outside of the sheet storing apparatus, and wherein the contact member is moved from a standby position to a moved position to discharge the sheet, wherein, in a state where the contact member is located in the standby position, the contact portion of the contact member is located upstream of the edge of the sheet conveyed by the conveyance unit in a direction in which the contact member is moved from the standby position to the moved position;

wherein the sheet storing apparatus further comprises:

an engaging portion;

a first moving unit configured to move the engaging portion in the sheet thickness direction to a position corresponding to any one of the plurality of engaged portions included in the plurality of sheet stacking units; and a second moving unit configured to engage the engaging portion which is moved by the first moving unit with the corresponding engaged portion to move the corresponding contact portion.

3. The sheet storing apparatus according to claim 1, wherein each of the plurality of engaged portions includes a first engaged portion configured to engage with the engaging portion when the contact member is moved from the standby position to the moved position, and a second engaged portion configured to engage with the engaging portion when the contact member is moved from the moved position to the standby position.

4. The sheet storing apparatus according to claim 1, wherein each of the plurality of engaging portions is mounted on a rotating member configured to rotate around a rotational center.

5. The sheet storing apparatus according to claim 1, wherein each of the plurality of contact members further includes a stacking moving portion provided to be movable integrally with the contact portion and configured to stack thereon the sheet conveyed by the conveyance unit.

6. The sheet storing apparatus according to claim 1, wherein the contact portion extends in the sheet thickness direction at a height configured to contact a plurality of sheets stacked on the stacking portion.

7. The sheet storing apparatus according to claim 1, further comprising a controller, wherein, while the controller causes a contact member of a first sheet stacking unit to move a first sheet in a direction perpendicular to a direction in which a conveyance unit of the first sheet stacking unit conveyed the first sheet, the controller causes a conveyance unit of a second sheet stacking unit to convey a second sheet onto a stacking portion of the second sheet stacking unit.

* * * * *